US005087107A

United States Patent [19]

Fumanelli

[11] Patent Number: 5,087,107

[45] Date of Patent: Feb. 11, 1992

[54] DEVICE AND PROCESS FOR PROTECTING AND HANDLING BANK NOTES AND VALUABLES

[75] Inventor: Giuseppe E. Fumanelli, Milan, Italy

[73] Assignee: M.I.B. Elettronica S.R.L., Peschiera Borromeo, Italy

[21] Appl. No.: 466,524

[22] Filed: Jan. 17, 1990

[30] Foreign Application Priority Data

| | | | |
|---|---|---|---|
| Jan. 19, 1989 | [IT] | Italy | 19122 A/89 |
| Feb. 6, 1989 | [IT] | Italy | 19324 A/89 |
| Mar. 13, 1989 | [IT] | Italy | 19744 A/89 |
| May 19, 1989 | [IT] | Italy | 20562 A/89 |

[51] Int. Cl.[5] ..... A47B 88/00

[52] U.S. Cl. ..... 312/319; 312/341.1; 312/348; 312/223

[58] Field of Search ..... 312/319, 223, 274, 341.1, 312/348

[56] References Cited

U.S. PATENT DOCUMENTS

| | | | |
|---|---|---|---|
| 1,742,542 | 1/1930 | Howell | 312/234 |
| 2,707,666 | 5/1955 | Becker | 312/319 |
| 2,873,159 | 2/1959 | Becker | 312/319 X |
| 2,964,370 | 12/1960 | Butler | 312/234 |
| 3,235,319 | 2/1966 | Anders et al. | 312/319 |
| 3,378,321 | 4/1968 | Frederick et al. | 312/319 X |
| 4,934,767 | 6/1990 | Hoyt et al. | 312/319 X |

*Primary Examiner*—Joseph Falk

*Attorney, Agent, or Firm*—Browdy and Neimark

[57] ABSTRACT

A device used for protecting and handling bank notes and valuables including, within a housing, a protection housing, mobile elements having a sliding direction and a plurality of safety compartments consecutive with one another along the sliding direction, locking elements defining as many stop positions of the mobile elements as there are safety compartments along the sliding direction, and a control device driving the locking elements. A process includes the insertion of bank notes and valuables in various safety compartments and making gradually accessible the content of compartments according to prefixed time sequences.

13 Claims, 4 Drawing Sheets

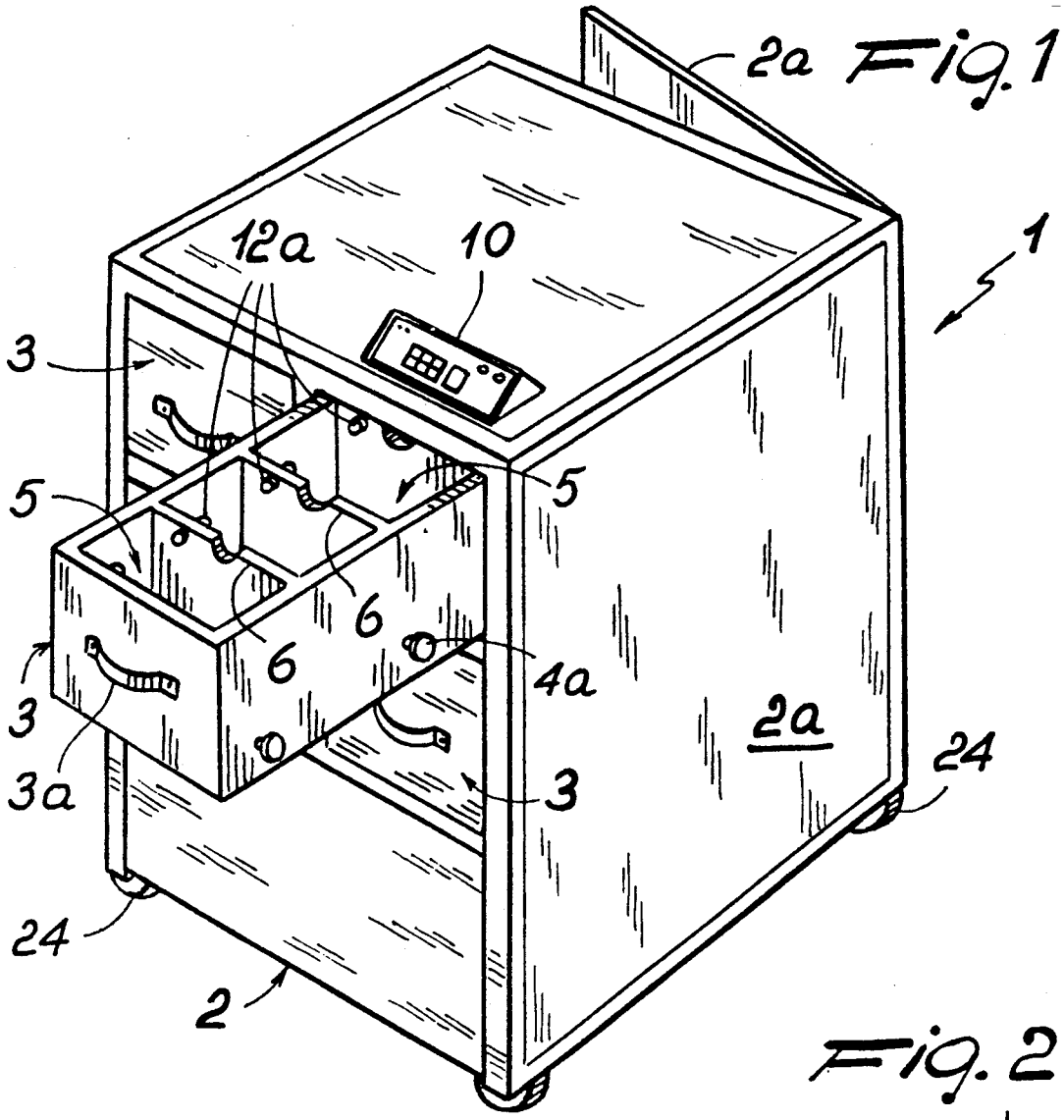
Fig. 2
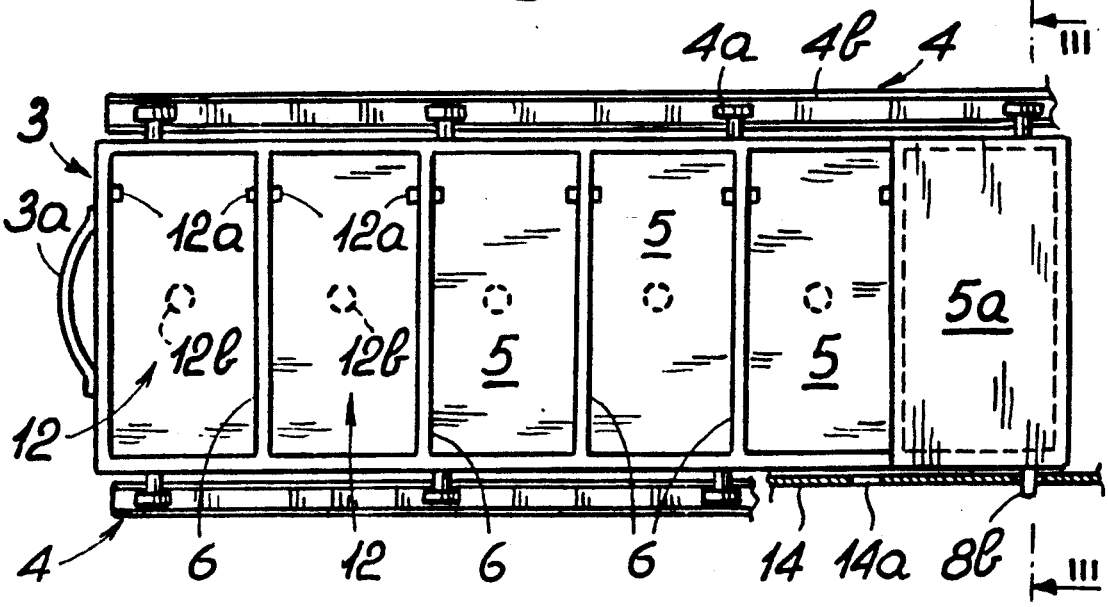

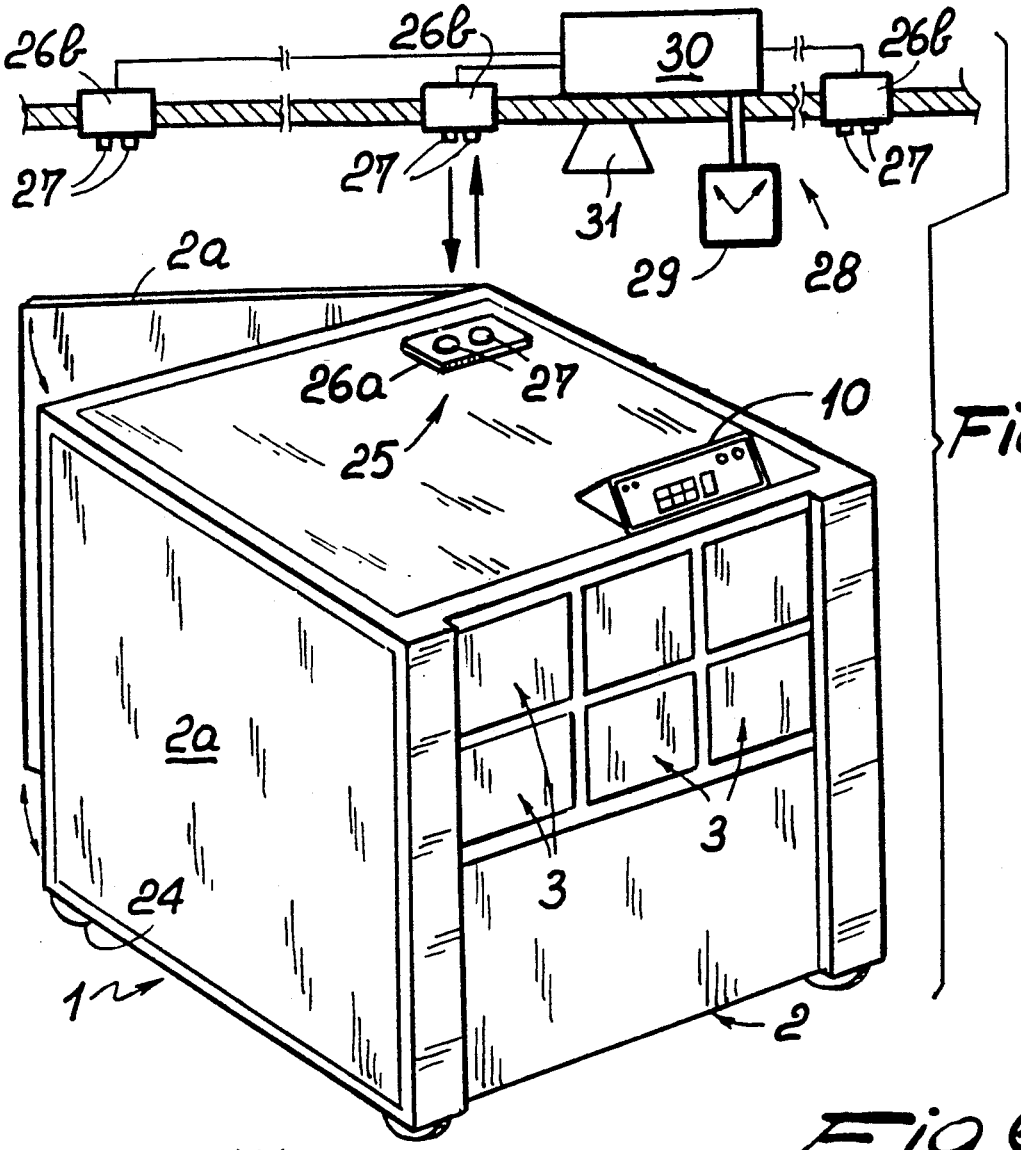
Fig. 7
Fig. 6
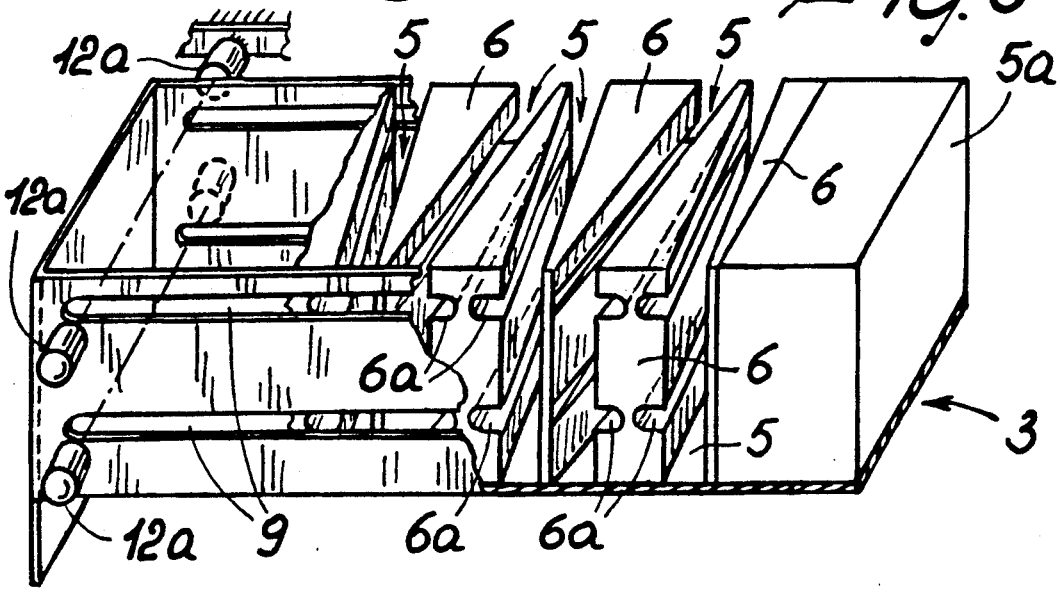

DEVICE AND PROCESS FOR PROTECTING AND HANDLING BANK NOTES AND VALUABLES

BACKGROUND OF THE INVENTION

The present invention has the scope of supplying a device and a process for protecting and handling bank notes and valuables.

It is well-known that the holding or keeping of bank notes and valuables, e.g. valuables such as documents, bonds, precious objects and money of various types, is done in many cases using safes or safety cubicles. These safes or the like protect the contents thereof only when they remain closed and preferably when there is an opening at a fixed time thereof, this time being not immediately modifiable.

Yet it is well-known that, when frequent drawing or deposit or control operations are performed, the use of safes or the like increases in a limited manner the safety, as the safes must practically remain open or must be immediately opened by the working personnel, and from the moment of the opening of a safe access is allowed to all valuables held therein. Therefore the eventual robberies or thefts are increased in some manner by the possibility of an intervention in a moment in which a safe or the like is open, or by the possibility of obtaining the opening of the safe by the working personnel, and by the following possibility of immediate appropriation of the whole contents thereof. It is also true that in the presence of real necessity of frequent handling or exchanges of bank notes and valuables the use of safes or the like must be rejected, since it is practically foreseen that they will always remain open, but as compensation for this absence of protection there is an increase in the protection in the environment in which the operations are carried out and above all it is attempted to impose limitations of the quantity of money available. Yet it is evident that these limits can be in some cases a serious obstacle in the execution of the work.

Finally it must be pointed out that the handling and storing of bank notes and valuables has been shown in many cases to be at an inadequate safety level, or a limited efficiency level.

SUMMARY OF THE INVENTION

In this situation the technical scope of the present invention is to supply a device and a process suitable for obviating substantially all of the above drawbacks and further supplying greater safety, and operating levels that are suitable for being adapted to various situations.

This specified technical scope is substantially achieved by a device used for protecting and handling bank notes and valuables including a housing and a protection housing forming the external walls of said housing, characterized in that it includes:

at least a mobile element supported by said housing and having an extension direction and a plurality of safety compartments suitable for holding bank notes and valuables, at least some of the compartments which are consecutive with one another along said extension direction, a sliding direction of said mobile element with respect to said protection housing, parallel to said extension direction and crossing at least an access position of said safety compartments from the outside of said protection housing, locking means for said mobile element internal to said protection housing and establishing a plurality of stop positions for said mobile element along said sliding direction, and a control device driving said locking means of said mobile element in a manner suitable for locating at choice said safety compartments in said access position.

The process includes the location of said bank notes and valuables in a plurality of safety compartments, and allows the gradual access to the contents of said safety compartments according to predetermined timer-controlled sequences.

BRIEF DESCRIPTION OF THE DRAWINGS

The characteristics of the invention shall be more apparent from the following description of some preferred embodiments of a device, and a process, according to the invention, illustrated in the annexed drawings, in which:

FIG. 1 shows a perspective view of a device according to the invention, in a particular embodiment;

FIG. 2 shows a plan view of a mobile element of the device shown in FIG. 1;

FIGS. 4, 5, and 6 show some variants of the mobile element shown in the preceding figures;

FIG. 7 shows a device according to the invention in an embodiment complete with location means directed towards the ceiling;

DESCRIPTION OF PREFERRED EMBODIMENTS OF THE INVENTION

Figure 8:
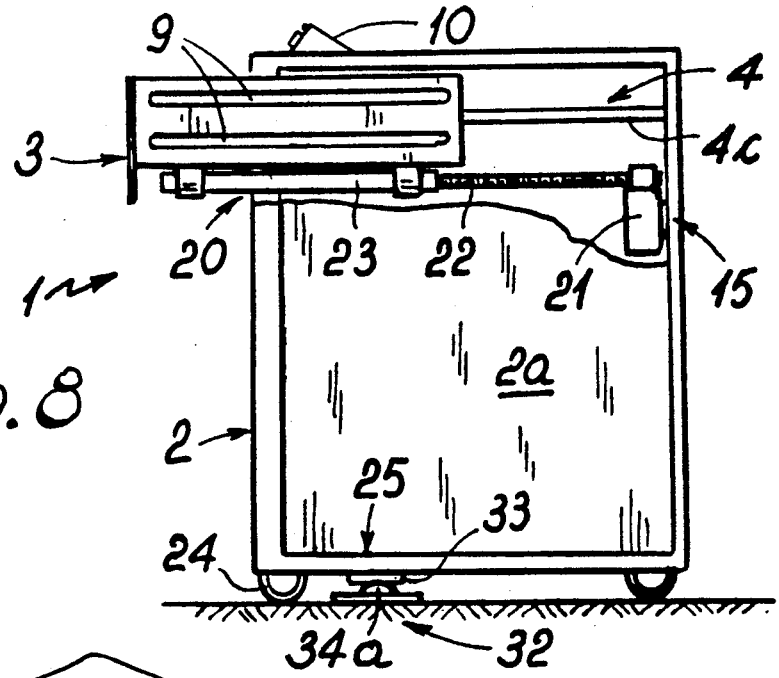
FIG. 8 shows in a lateral view the device of FIG. 7.

With reference to the above described figures, the device according to the invention is generally indicated with the reference number 1. This device includes a housing 2, whose external walls are established by an armor-plating or protection housing 2*a*. Housing 2 supports mobile elements 3 that can be extracted along sliding directions parallel to the extension directions of the same mobile elements 3. The figures show mobile elements 3 formed by drawers extractable from protection housing 2*a* sliding along guide elements 4. FIGS. 1–4 show the guide elements 4 that consist of rollers 4*a* and rails 4*b*, while FIG. 8 shows the linear guides 4*c*. Rails 4*b* and linear guides 4*c* establish the sliding direction of the drawers or mobile elements 3, perpendicular to a face of housing 2 and parallel to the main extension direction of drawers 3.

Each drawer 3 is divided into safety compartments 5 consecutive with one another and parallel to the sliding direction. The division is established by safety bulkheads 6 extending transversally to said sliding direction. The illustrated safety compartments 5 are of the size of bank notes to be put therein, alternatively in horizontal or vertical directions, so that they can hold measured quantities thereof. Safety bulkheads 6 can be either fixed or mobile, when this last solution does not damage the fastening of said bulkheads or prevent the movement thereof when the bulkheads are inserted, even only partially, into protection housing 2*a*.

On its inside, housing 2 is provided with position sensors 7 suitable for surveying the position of each drawer 3 with respect to protection housing 2*a*. Further, there are lock members 8 suitable for locking the drawers 3 in a plurality of positions with respect to protection housing 2*a*, these positions of safety compartments 5 being protection of access positions of the said compartments from the outside of protection housing 2a. Said protruding positions corresponds to the gradual withdrawal of safety compartments 5 from housing 2a. Preferably there are not predetermined possible intermediate positions in which any safety compartment 5 only partly protrudes from housing 2a.

Figure 5:
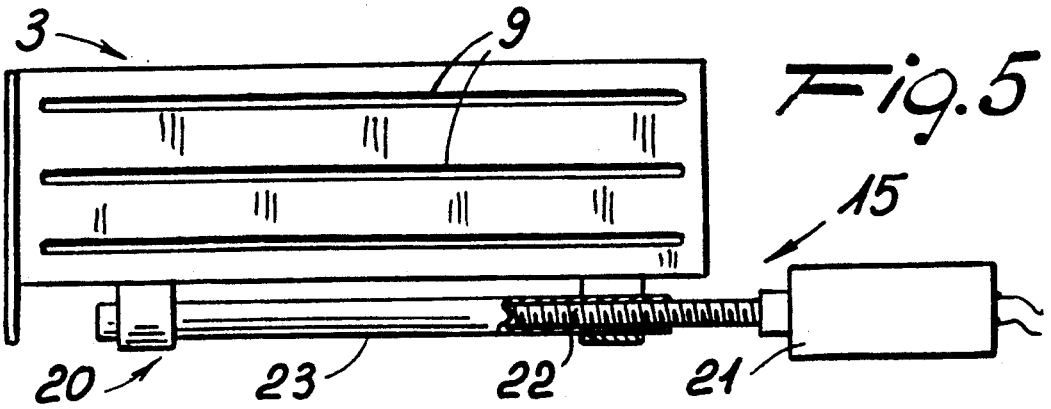

Position sensors 7 form a part of a control device 11 that is suitable for actuating lock members 8 and including further quantity sensing members 12 suitable for surveying the presence of bank notes and valuables in safety compartments 5. Numerous advantageous technical solutions are possible in relation to the quantity sensors 12. Quantity sensors 12 shown in FIGS. 1 and 2 include, in each safety compartment 5, an emitter and a receiver 12a, exchanging e.g., infrared signals or ultrasonic vibrations modulated according to a previously programmed code, located in opposed zones of each compartment 5, so that the content of each compartment interferes with the same signals. On the contrary the quantity sensors 12, shown in FIGS. 5, 6, and 8 are external to the mobile elements of drawers 3 and located near the opposite sides of each drawer 3. In particular, in each drawer 3 there are two or three pairs of emitters and receivers 12a spaced from one another and engaged in a position protected on the inside of housing 2a. They survey the content of safety compartments 5, to which they are external, by means of slots 9 machined in the sides of drawers 3. FIGS. 6 and 8 show also that emitters and receivers 12a are positioned at a location fixed near the front wall of housing 2 and therefore they survey the presence of bank notes or valuables in safety compartments 5 during the extraction of the drawers 3 from housing 2a. Furthermore, these pairs of emitters and receivers 12a are located in a manner suitable for controlling zones of different heights in safety compartments 5 for emitting not only the signals referring to completely full compartments or completely empty compartments, but also signals indicating the filling level.

With reference to FIG. 6, it must be noted that safety bulkheads 6 consist of wedge-shaped blocks flanked in alternated positions and spaced from one another for forming compartments sloping with respect to said sliding direction, so that even one single bank note, located sloping and laid in vertical of horizontal directions onto an edge thereof, can interfere with emitters and receivers 12a. Furthermore, the said block-shaped safety bulkheads show grooves 6a located at the height of slots 9 of a size establishing on the whole ports having a direction mainly perpendicular to the sides or edges of drawers 3, for making easier the surveys of emitters and receivers 12a, with these elements also aligned perpendicular to the sides of drawers 3.

As indicated with dashed lines in FIG. 2, there are also quantity sensors 12 consisting of a photovoltaic cell 12b, located on the bottom of each safety compartment 5. In this manner the photovoltaic cell 12b can be dimmed by the content of the compartment and on the contrary it can be activated by the ambient light, when the compartment is completely empty.

Also, it is understood that quantity sensors 12 can be made up of well-known load cells, suitable for surveying the load variations that occur internally to the whole drawer 3, or internally to each compartment 5, located between the bottom of drawer 3 and a tray element establishing the common basis of one or more safety compartments 5.

Control device 11 includes position detectors 7 and quantity sensors 12 which are joined to logic circuits 11a, in which the information transmitted by position detectors 7 and by quantity sensors 12 is processed in the functioning of the control of locking means 8. Logic circuits 11a include timing elements or circuits suitable for adjusting lock means 8 according to predetermined time sequences, so that the gradual extraction of safety compartments 5 is synchronized with the foreseen necessities of money drawing. Control device 11 is also interlocked with alarm and/or protection means, e.g. of an acoustic type, and external signaling members 10, for alerting the working personnel.

Figure 3:
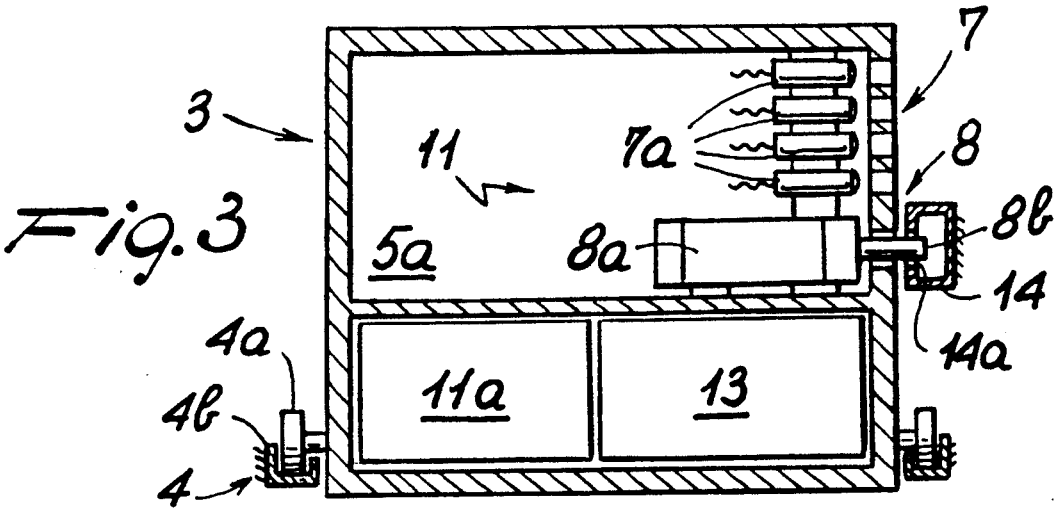
FIG. 3 shows the section III—III of FIG. 2.

Further, it must be noted in detail that FIGS. 2 and 3 show an embodiment of the device 1, in which control device 11, lock means 8, and also electrical source unit 13 are located on the inside of each drawer 3, occupying the sole last closed compartment 5a, as shown in FIG. 2. This embodiment includes control device 11, showing position detectors 7, made up of proximity switches or sensors 7a, sensitive to stops placed externally to drawers 3, while lock means 8 consists of an electrically driven piston 8a. This piston 8a shows a rod 8b that is engaged in the proper holes 14a of a bar or pipe 14, fixed and internal to protection housing 2a.

Figure 4:
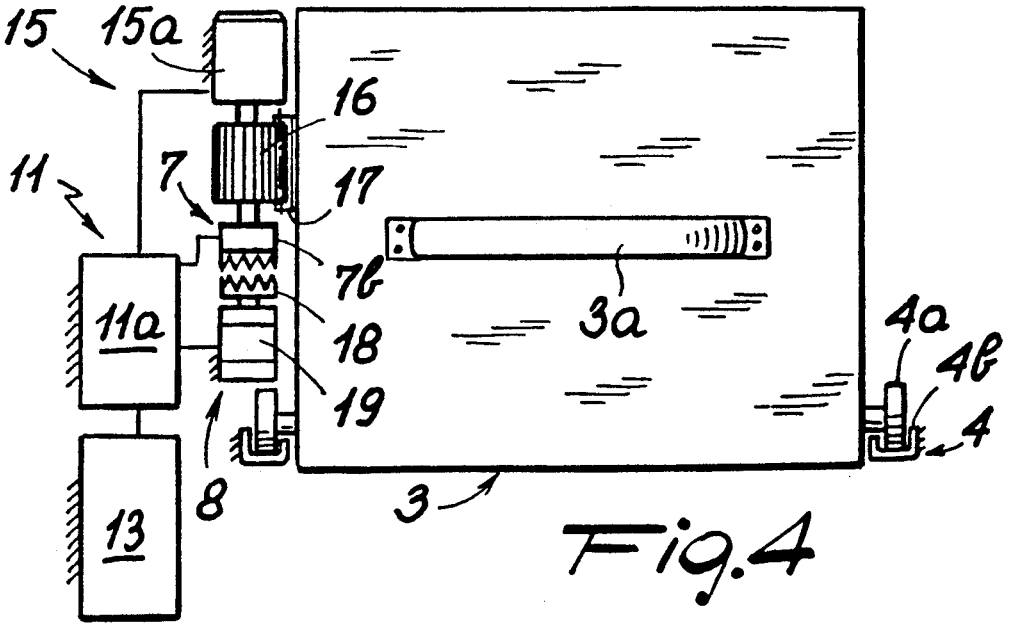

FIG. 4 shows an embodiment of the device 1, in which control device 11, lock means 8, and electrical source unit 13 are located on the outside of drawers 3. Furthermore, there are drive members 15 for drawers 3, interlocked to control device 11. Drive members 15 can move mobile elements or drawers 3 in two opposed directions, for automatically extracting new safety compartments 5, when housing 2 is being emptied, or for closing the just filled safety compartments 5, when housing 2 is even partially filled. Drive members 15 include, for each drawer 3, a reversible electric motor 15a that drives a gear 16 engaged with a rack 17 joined to the lateral side of drawer 3. Control device 11, shown in FIG. 4, includes position detectors 7 consisting of a position sensor 7b that measures the rotation of gear 16.

It must be noted that the various members of FIG. 3 can also be installed externally to drawer 3, while the members of FIG. 4 can be internal to drawer 3. For example, piston 8a (FIG. 3) can operate at the outside of drawer 3, while gear 16 (FIG. 4), located in the inside together with electric motor 15a, can mesh with an external and fixed rack 17, through a slot made in drawer 3. Lock means 8 of FIG. 4 is formed by a stop element 18 that acts through teeth on position sensor 7b, joined to gear 16. For controlling the axial movement of stop element 18, there is an electromagnet 19.

Considering the embodiment illustrated in FIGS. 5 and 8, drive members 15 consist of linear actuators 20 parallel to drawers 3 and driven by motor units 21. Motor units 21 are preferably electrically driven geared motors and linear actuators 20 are preferably telescopic rods; a first telescopic rod 22 in screw form, turned directly by a geared motor 21, and a second telescopic rod 23 made in bush or nut screw form, winding on first telescopic rod 22 and fixed externally to mobile element or drawer 3. A pair of the telescopic rods 22 are extended between the front and back walls of protection housing 2a, and geared motors 21 are near to the back wall. Linear actuators 20 can also be of an oil-operated type and include oil-operated pistons joined, by pipes, to an electrically driven pump.

It must be understood that drive members 15 shown in FIGS. 5 and 8 are suitable for moving drawers 3 and for forming locking means 8, as they can establish the fixed locking of drawers 3 by the simple stop of geared motors 21 that move drawers 3 in two directions. In any case, mobile elements 3 can be moved manually in two directions, if and for as far as the lock members 8 allow this movement. For this purpose handles 3*a* are on drawers 3, as shown in FIGS. 1, 2, and 4.

Housing 2 is preferably mounted on wheels or rollers 24, as shown in FIGS. 1, 7 and 8, to be moved easily, and it is supplied with location means 25, partially positioned on a ceiling (FIG. 7) or on a concrete floor (FIGS. 8–11). FIG. 7 shows first location element 26*a* associated with housing 2 and second fixed location elements 26*b*, located on a ceiling along paths determined according to predetermined positions and handling of housing 2. Location elements 26*a* and 26*b* include some transmission and receiving devices 27, suitable for emitting and/or receiving infrared rays or radio waves or ultrasonic vibrations, that cause position signals. FIG. 7 shows that second location elements 26*a* are spaced from one another and therefore the sole element 26*b* which is over housing 2 surveys the presence of housing 2 and communicates with the housing by means of devices 27.

Receiving and transmitting devices 27 are preferably suitable for communicating the signals indicating the condition of drawers 3 to a control device 28. Control device 28, as illustrated in the example shown as separated from housing 2 and located on the ceiling, includes both clock and calendar circuits 29 suitable for sending time signals, and logic circuits 30, suitable for processing and controlling the position signals and the status signals corresponding to closing and opening positions of drawers 3. Furthermore, there are alarm elements, including an acoustic buzzer 31, interlocked to control device 28.

FIG. 8 shows that housing 2 can be positioned over stations 32 placed in a concrete floor. Stations 32 are located in the back of the zone where it is required to position housing 2 or in the front zone thereof or also along the paths followed by housing 2 during its movements forward and backward. Housing 2 of FIG. 8 shows location means 25 activated towards stations 32 and including, under a bottom face, first sensing device 33, having some electrical contact terminals, suitable for causing position signals when put in contact with a corresponding second sensing device 34 machined into stations 32.

Figure 9:
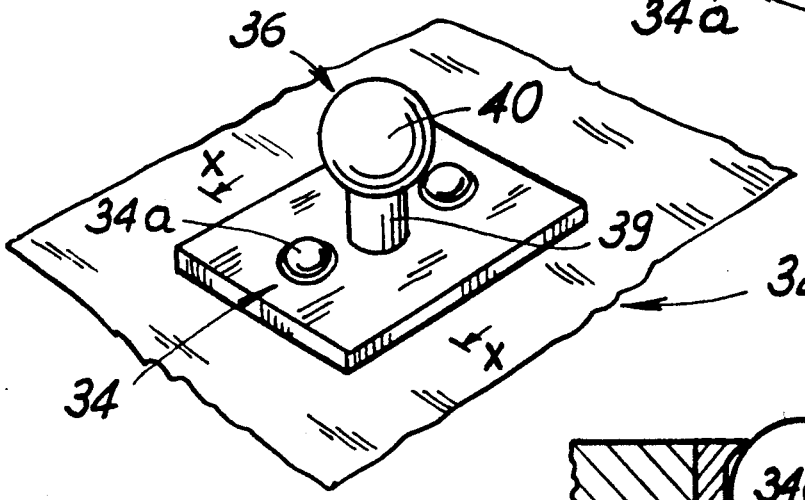
FIGS. 9, 10, and 11 show the location means of FIG. 8 and concrete floor locking members.
Figure 10:
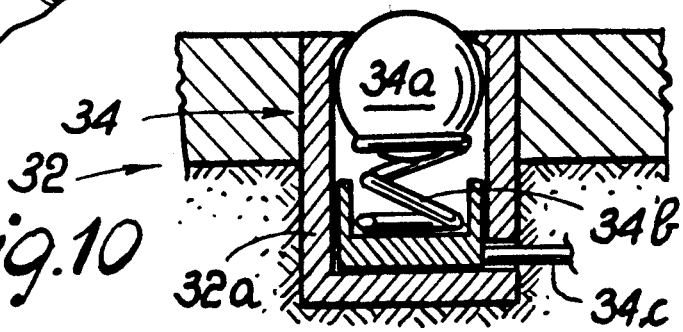
Figure 11:
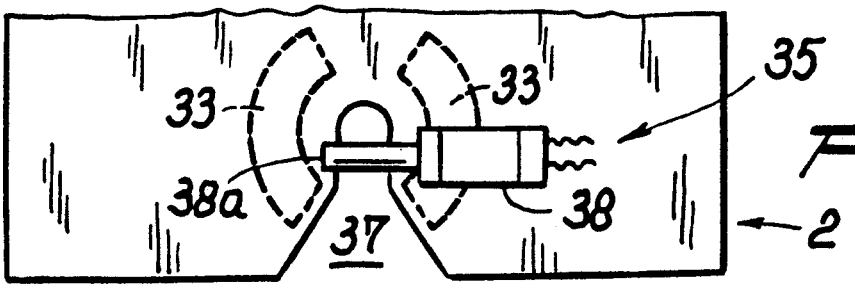

The embodiment shown in FIGS. 9, 10, and 11 includes the electrical contacts of the first sensing device that are shaped in the circumference of an arc and the second sensing device 34 that is defined by contact elements suitable for assuring an elastic contact in a vertical direction. In fact, in stations 32 there are some conductive balls 34*a* inserted in bushes 32*a* made of insulating material. Each conductive ball 34*a* is spring-loaded by a spring 34*b* introduced into bush 32*a* and electrically conductive and further electrically joined with cable 34*c*. Control device 28 is joined with cables 34*c*, and first sensing device 33 can emit recognition signals that locate housing 2 when present at each one of stations 32.

Furthermore, there are locking means fixing housing 2 to the ground, including coupler device 35 (FIG. 11) located in conjunction with the bottom of housing 2 and suitable for being engaged with projection 36 (FIG. 9), fixed and protruding from station 32.

Coupler device 35 includes seat 37 gradually narrowing toward a reduced bottom 37*a* and closing member 38 supplied with a stem 38*a*, mobile and electrically or hydraulically driven, suitable for closing off reduced bottom 37*a*. Projection 36 with an expanded end showing stem 39 dimensioned according to the reduced bottom 37*a* and ending with an expanded bulb 40 preventing the lifting of housing 2, can be inserted into seat 37. Closing member 38 of coupler device 35 is driven directly by control device 11 or by control device 28.

The operation of the device occurs as follows: During the initial introductory phase of valuables or bank notes, the mobile elements are gradually closed, compartment by compartment, when each compartment is filled. The closing can be made directly by an operator, who, after having filled a safety compartment 5, inserts the compartment into the closed and protected position on the inside of protection housing 2*a*, signaling, e.g. by means of signaling members 10, that the just inserted safety compartment 5 is filled. This signal causes the operation of locking means 8. Preferably device 1 is supplied with quantity sensors 12 and the signal that a compartment is filled is sent automatically by quantity sensors 12. Also preferably, device 1 is supplied with drive members 15 and position detectors 7 and therefore all movements of drawers can be controlled automatically.

After the end of the total or partial loading operation of safety compartments 5, the following opening operations of the same compartments, i.e. of gradual or periodically unlocking of locking means 8, are adjusted by logic circuits 11*a* of control device 11, that control by time, according to a predetermined frequency, the progressive access to safety compartments 5. When control device 11 is supplied with quantity sensors 12, it is possible to determine that the filled or not quite empty safety compartment 5 can be freely accessible and that eventually only a second more internal consecutive compartment can also be extracted freely from protection housing 2*a* in a manner suitable for guaranteeing a certain availability of bank notes or valuables. The other more internal compartments become gradually accessible only when quantity sensing members 12 of accessible external compartments have supplied suitable indications to control device 11, e.g. showing an empty compartment and above all, after a minimum predetermined time interval from the opening of more external compartments has passed.

The loading and closing operations and the opening and drawing operations can be alternated with one another, as it is always possible to fill one or more safety compartments 5 and obtaining, automatically or manually, the immediate insertion of compartments as soon as they are loaded, into protection housing 2*a*. As soon as these compartments are inserted into protection housing 2*a*, they are treated as all other compartments and therefore they are accessible only when the adjacent compartments are empty and there has elapsed a minimum time predetermined for emptying of the same compartments.

In the presence of a sudden emptying due to criminal actions, the delay necessary for the extraction of safety compartments 5 internal to protection housing 2*a*, and an eventual alarm caused by forced drawing, limits greatly the losses without causing danger to the working personnel, since there is no means for accelerating the extraction or for stopping the alarm procedures that have been tripped.

When device 1 is supplied with location means 25, mounted on a cement floor or ceiling, control device 28 receives the position signals of housing 2. These signals are compared with data related to positions predetermined versus time. If disagreements between the position signals and said data are found, then alarm means, e.g. acoustic buzzer 31, is actuated.

Housing 2 can be joined fixedly to one station 32 by locking means 35,36, using closing member 38. The possibility of movement of device 1 and the presence of location means 25 make possible, in particular, the loading of various drawers 3 in protected positions of a bank and transport under safe conditions, e.g. towards the various bank counters.

The invention also involves a new process that allows the insertion of bank notes and valuables in a plurality of singularly protected safety compartments 5, and making gradually accessible the same safety compartments according to predetermined timer-controlled sequences. There are both filling and closing phases and opening and drawing phases, and the filling and closing phases are made freely while the opening and drawing phases are committed to predetermined timer-controlled sequences. Further, the opening and drawing phases are operated on all the safety compartments that were submitted to the filling and closing phases, independently from the execution times of the filling and closing phases. In other words, the just closed and protected safety compartments 5 are treated similarly with other just filled compartments. Therefore they can be opened again only in respect to the predetermined time sequences.

The invention fulfils important advantages. In fact, the device fulfils on one hand an efficient protection against the abusive removal of valuables held therein, limiting greatly the losses, and on the other hand, it is simple and functional and suitable for many situations. In fact no obstacle is interposed in the storage of bank notes and valuables. Furthermore, the protection is also extended in precedence to the valuables as stored. And further, the protection can be predetermined so as not to compromise the normal or usual money flow. In fact the time intervals necessary for making gradually accessible newly filled safety compartments can be programmed according to specific experimental or foreseeable work necessities.

Further, housing 2 can be used both as a fixed installation and as a means for transporting valuables.

I claim:

1. A device for protecting and handling bank notes and valuables comprising a housing;

a protection housing forming external walls of said housing;

at least one mobile element supported for movement in said housing including a drawer movable in a direction for extraction of said drawer out of said protection housing;

safety compartments within said drawer having safety bulkheads forming walls of said safety compartments, said safety compartments being of a size substantially dimensioned for holding a measured quantity of the bank notes;

at least two of said safety compartments being consecutive with each other in said drawer in said extraction direction of said drawer;

said extraction direction of said drawer allowing access to said safety compartments from outside of said protection housing;

mobile element locking means attachable to said mobile element at a plurality of stop positions in movement of said mobile element along said extraction direction;

a control device connected to drive said locking means at said plurality of stop positions for access to said safety compartments;

said control device including quantity sensors connected to operate said mobile element locking means and having means to detect the presence of the bank notes and valuables in said safety compartments.

2. The device according to claim 1 wherein said quantity sensors include in said detecting means, at least a photovoltaic cell dimmed by the presence of the bank notes and valuables in said safety compartments.

3. The device according to claim 1 wherein said quantity sensors include in said detecting means, at least a load cell to detect load variations in said safety compartments.

4. The device according to claim 1 wherein said quantity sensors include in said detecting means at least one emitter and receiver means to exchange signals, located in spaced opposed positions from each other, where said signals are interfered with by content of said safety compartments.

5. The device according to claim 4 wherein opposite sides of said mobile element have slots allowing transmission of signals between said emitter and receiver means therethrough;

and said emitter and receiver means are located in fixed positions adjacent to opposite sides of said mobile element.

6. The device according to claim 1 wherein said safety bulkheads are blocks sloping with respect to said extraction direction of said mobile element;

said blocks having grooves extending substantially perpendicular to said extraction direction;

at least one emitter and receiver means aligned with each other perpendicular to said extraction direction for allowing signal exchanges through said grooves.

7. The device according to claim 1 wherein drive means is connected to said mobile element to move said mobile element in said extraction direction and in a closing direction opposite to said extraction direction;

said drive means is also connected to said control device for control by said control device;

said control device includes position detecting means to sense the position of said mobile element with respect to said protection housing;

said position detecting means includes corresponding stops selectively engaged with said mobile element and said housing, and proximity sensors arranged to detect said corresponding stops when at the location of said stops.

8. The device according to claim 7 wherein said drive means include an electric motor, a gear driven rotatably by said electric motor, a rack engaging said gear, said electric motor and said rack being engaged selectively with said housing and said mobile element;

said detecting means includes a position sensor to sense the angular position of said gear, and said mobile element locking means includes a stop element for locking said gear.

9. The device according to claim 7 wherein said drive means includes a linear actuator extending perpendicular to said mobile element, and a motor unit connected to said linear actuator for controlling said linear actuator.

10. The device according to claim 1 wherein said mobile element locking means includes a piston, a rod movable transversally to said extraction direction and driven by said piston, and a bar having holes engaged by said rod, said piston and said bar being engaged selectively to said mobile element and said housing.

11. The device according to claim 1 wherein said housing includes wheels supporting said housing on a ground surface, location means to send position signals;

a housing location controlling device outside of said housing and joined to said location means;

said location means includes a first location element attached to said housing and mobile therewith, second location elements fixed externally of said housing, said first and said second location elements include transmitting and receiving devices of said position signals.

12. The device according to claim 1 wherein said housing includes wheels supporting said housing on a ground surface, location means to send position signals;

a housing location controlling device outside of said housing and joined to said location means;

said location means includes first sensing devices attached to said housing, and second sensing devices located substantially at a ground surface level, fixed and engageable by contact to said first sensing devices.

13. The device according to claim 1 wherein said housing includes wheels supporting said housing on a ground surface, and housing locking means to lock said housing in a plurality of stop positions establishing fixed stations, said housing locking means includes a coupler device joined to said protection housing, and an expanded portion device fixed to the ground surface in conjunction with each one of said fixed stations and engageable by setting with said coupler device.

* * * * *